United States Patent [19]

Fisher

[11] 4,397,631

[45] Aug. 9, 1983

[54] PRE-MIX FORCED DRAFT POWER GAS BURNER

[75] Inventor: Leonard A. Fisher, Granby, Conn.

[73] Assignee: The Carlin Company, Windsor, Conn.

[21] Appl. No.: 185,175

[22] Filed: Sep. 8, 1980

[51] Int. Cl.[3] ..... F23Q 3/00

[52] U.S. Cl. ..... 431/114; 431/265; 431/328; 431/350; 239/557; 239/567

[58] Field of Search ..... 431/263–265, 431/328, 329, 326, 347, 348, 350, 354, 114; 126/92 R, 92 B; 239/556–559, 567; 29/157 R, 157 C

[56] References Cited

U.S. PATENT DOCUMENTS

| | | | |
|---|---|---|---|
| 2,744,568 | 5/1956 | Johnson | 431/284 |
| 2,840,152 | 6/1958 | Reed | 431/350 |
| 2,869,626 | 1/1959 | Sherman | 431/347 |
| 3,799,732 | 3/1974 | Brödlin | 431/350 |

FOREIGN PATENT DOCUMENTS

| | | | |
|---|---|---|---|
| 1065243 | 10/1979 | Canada | 431/328 |
| 2313127 | 9/1974 | Fed. Rep. of Germany | 431/353 |
| 1537037 | 12/1978 | United Kingdom | 431/265 |

*Primary Examiner*—Lee E. Barrett

*Attorney, Agent, or Firm*—H. Gibner Lehmann; K. Gibner Lehmann

[57] ABSTRACT

A forced-draft gaseous pre-mix power gas burner having a shaped and perforated burner plate wherein the hole sizes are related to the plate thickness and the holes are formed in a unique pattern, all of which prevent flashback and noise or screech while at the same time flame stability is greatly improved. The burner plate is easily installed and removed, is essentially free from stresses which would distort it, and readily fits positively and accurately within the burner assembly without resorting to welding or other special fasteners. A novel ignition-improving device for effecting a stagnant flow at the ignition arc location provides for quick and reliable ignition of the gas at all times.

9 Claims, 29 Drawing Figures

Fig. 20

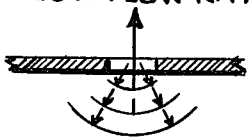

FLAME PROPAGATING AGAINST FLOW. FLASHBACK; HOLE TOO LARGE.

Fig. 21

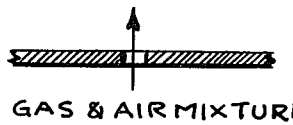

HOLE IS SMALLER. FLAME WILL GO OUT OR QUENCH BEFORE FLASBACK IF HOLES ARE SMALL ENOUGH.

Fig. 22

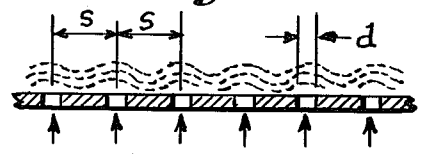

HOLES FAR APART ($S/d \cong 2-3$)
HIGH FREQUENCY FLAME OSCILLATIONS CAUSE SCREECH OR HOOT

Fig. 23

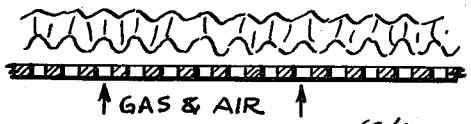

HOLES CLOSER SPACED ($S/d \cong 1.5-1.$) COALESCING, LIFTING FLAMES ARE QUIET, NO SCREECH. HOLES ARE CLOSELY SPACED

Fig. 24

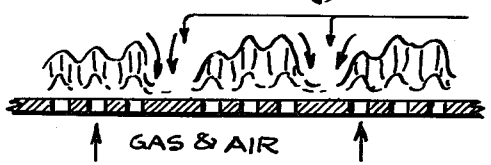

AVENUES WITH NO HOLES WILL STABILIZE FLAMES & STOP LIFTING NO SCREECH OR HOOT.

Fig. 25

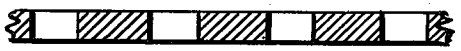

THICKER STEEL REQUIRES LARGER PUNCHES. RESULT: FLASHBACK, SCREECH.

Fig. 26

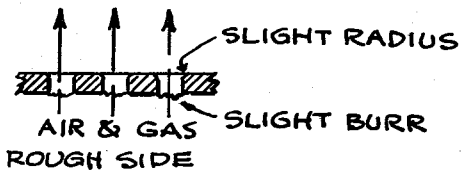

GAS FLOWING FROM ROUGH SIDE PROVIDES MORE TURBULENCE, BETTER COMBUSTION, A SHORTER, MORE STABLE FLAME.

PRE-MIX FORCED DRAFT POWER GAS BURNER

BACKGROUND

This invention relates to forced draft gas burners, and more particularly to burners of this type wherein a gaseous pre-mix is burned at an expansive combustion head.

It is known to use a perforated plate as a burner head in gas furnaces, for the purpose of establishing a base for the flame. In operating burners of this type a number of drawbacks were discovered. For one thing, the combustion tended to be noisy, having a high-pitched sound or screech due to the turbulence and burning of the gases at the combustion face of the burner head. Also, it was found that such burners lacked stability of the flame. Where the holes or perforations were closely spaced, the flame had a tendency to lift off or float away from the combustion face, which was an especially undesirable condition.

In all burners of the kind indicated it is necessary for the holes in the burner head to be small enough to prevent flash-back at low fuel velocities. And when attempts were made to improve the flame stability by a greater spacing of the holes, it was found that the noise level undesirably increased, and vice versa. The screeching or noise was quite piercing, and became an important factor in the performance of the burner.

Additionally, in burners of the above type there were difficulties with the ignition of the gases, and safety devices of one kind or another were provided to prevent the continued flow of gas in the event of ignition failure.

In certain instances the stresses which accompanied the continual heating and cooling of the burner head would cause the same to be distorted, ultimately adversely affecting the performance of the furnace.

When the burner head became distorted, the matter of replacement had to be considered, and it was found that a distorted burner head would result in problems involved with its removal from the associated assemblies.

SUMMARY

The above disadvantages and drawbacks of prior gas-fired burners are obviated by the present invention, and one object of the invention is to provide a novel and improved, forced-draft gaseous pre-mix burner which has an especially quiet operation together with excellent flame stability.

Another object of the invention is to provide an improved burner plate for a gas burner head, which is particularly easy to install and remove, and which is essentially free from distorting stresses which would deform it because of the cyclic heating and cooling of the plate.

A still further object of the invention is to provide an improved gas burner head as above characterized, wherein greatly improved ignition is had in consequence of effecting a stagnant flow of gas at the location of the ignition arc.

The above objects are accomplished by the provision of an improved burner head for gaseous fuel, wherein a burner plate having a combustion face is provided with a multiplicity of groups of apertures that are separated by solid avenue portions, thereby to enable the gaseous fuel to pass through for ignition only at designated areas of the combustion face. The flow of fuel is prevented at adjoining areas, and as a consequence of the pattern established by the apertures in conjunction with their diameters as related to the thickness of the burner plate, there is largely eliminated the noise or screech of the combustion while at the same time a desirable flame stability is had.

The burner plate is preferably in the shape of an annulus and has a major central portion of semi-doughnut shaped configuration. The outer peripheral portion of the burner plate is generally conical, with the net result that the thermal stresses which distort are greatly minimized whereby deformation of the plate is prevented, even over an extended period of use.

Near the central opening of the burner plate an ignition ground ring is provided, having a special configuration which creates a stagnant area of flow of the gas. At this area the ignition spark is located, resulting a reliable ignition at start-up, at all times.

Short, cylindrical sections are formed at the inner and outer peripheries of the burner plate, which facilitate its mounting and placement in the burner assembly.

Other features and advantages will hereinafter appear.

In the accompanying drawings, which illustrate several embodiments of the invention:

FIG. 20 is a diagrammatic fragmentary sectional representation, enlarged, of a burner plate illustrating the flow behavior through a plate hole if it is too large.

FIG. 21 is a view like that of FIG. 20 but where the plate hole is smaller.

FIG. 22 is a view like those of FIGS. 20 and 21, showing smaller holes spaced apart too far.

FIG. 23 is a view like that of FIG. 22, showing the holes spaced closer.

FIG. 24 is a view like that of FIG. 23 but with solid avenue areas provided between groups of holes in accordance with the invention.

FIG. 25 is a fragmentary section through a burner plate of thicker metal, illustrating the relative hole sizes with respect to metal thickness.

FIG. 26 is a fragmentary section through a burner plate, showing burrs resulting from punching of the holes.

Figure 1:
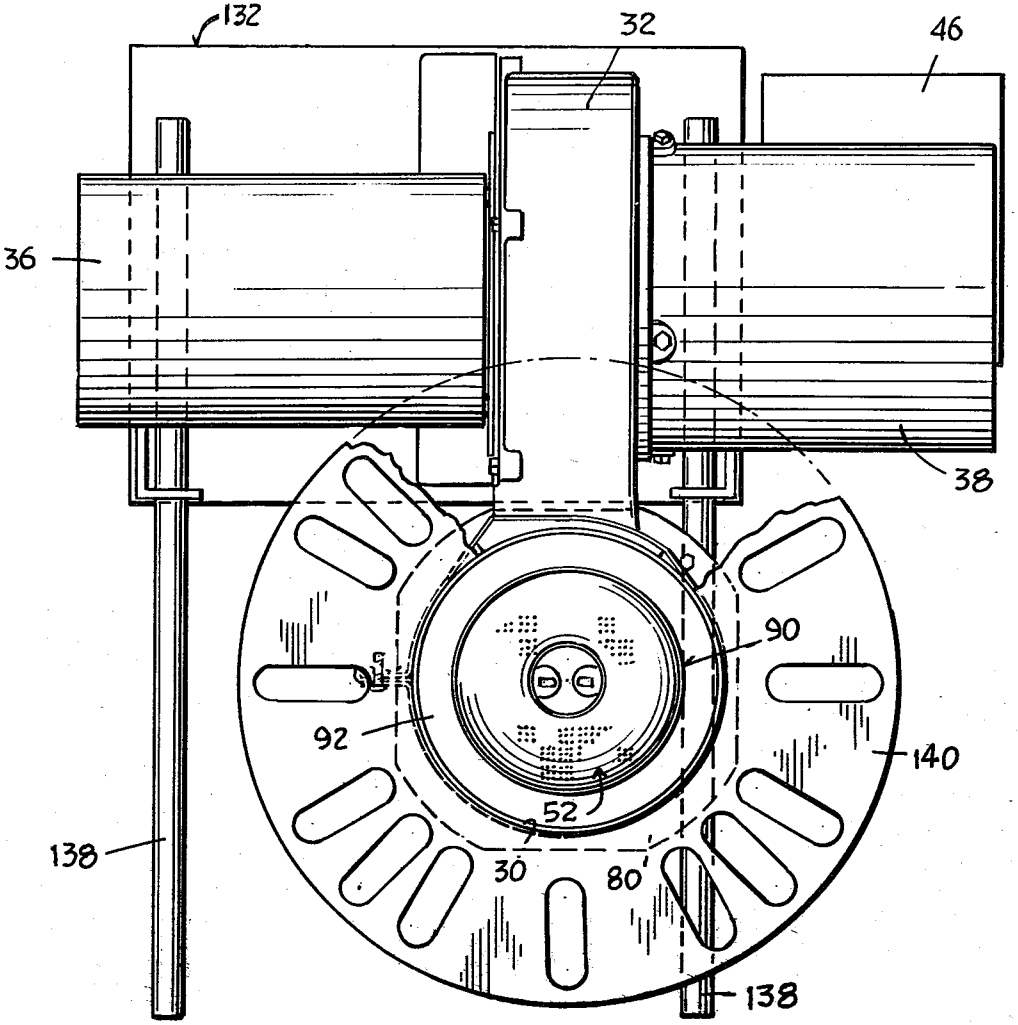
FIG. 1 is front elevational view of the improved, forced-draft power gas burner of the invention.
Figure 2:
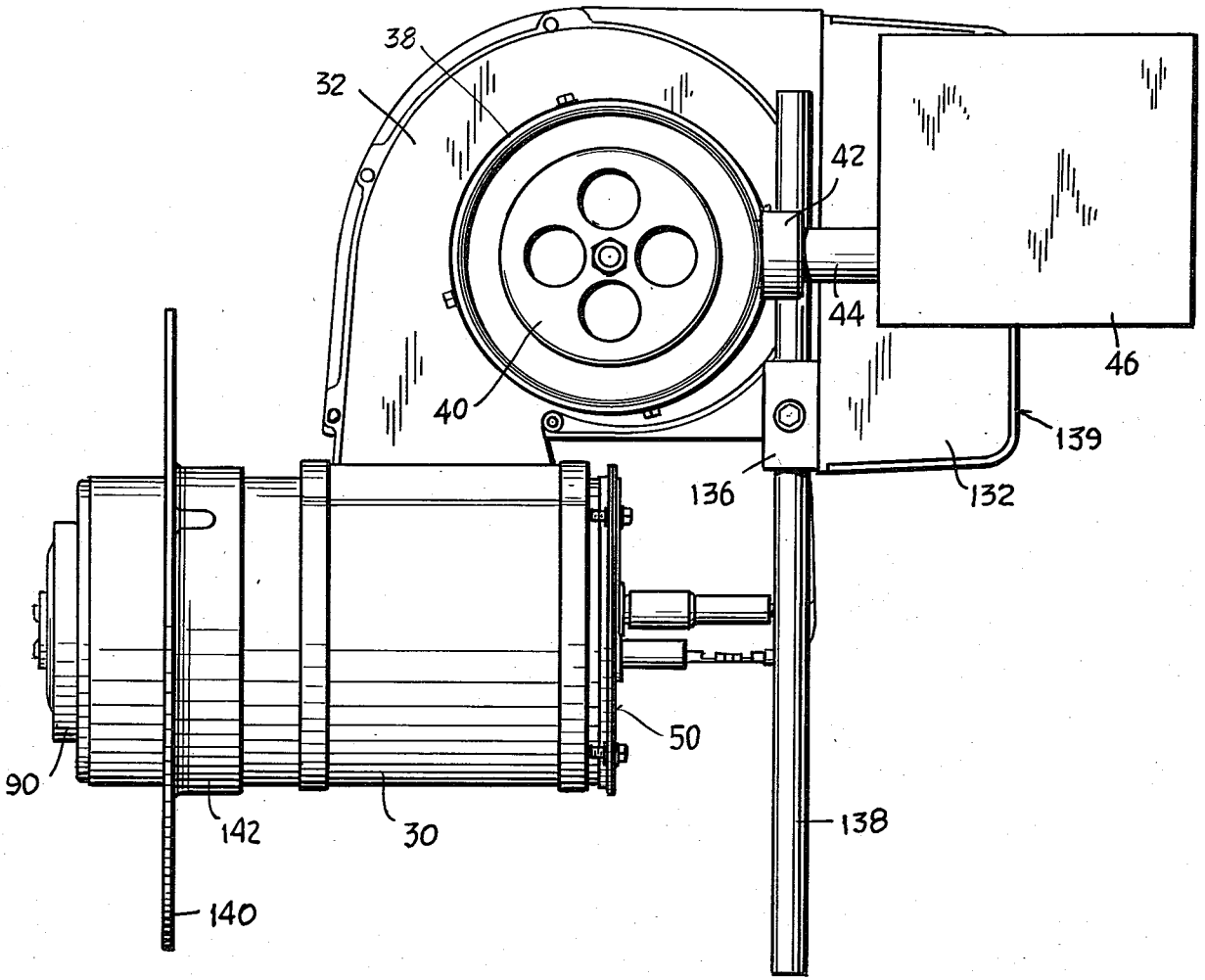
FIG. 2 is a left side elevational view of the gas burner.

As shown, FIGS. 1 and 2 are exterior views of the burner, and may be referred to later as the description of the invention proceeds. However, an initial understanding of the construction of the present gas burner can be had more readily by referring first to FIG. 3. In this Figure there is illustrated an air tube 30 which has mounted on its top side at the rear a blower housing 32 in which there is disposed a usual type of blower squirrel cage 34 powered by an electric motor 36 (see also FIGS. 1 and 13). The electric blower has an air input comprising an air inlet tube 38 shown in FIGS. 1, 11 and 12.

Figure 11:
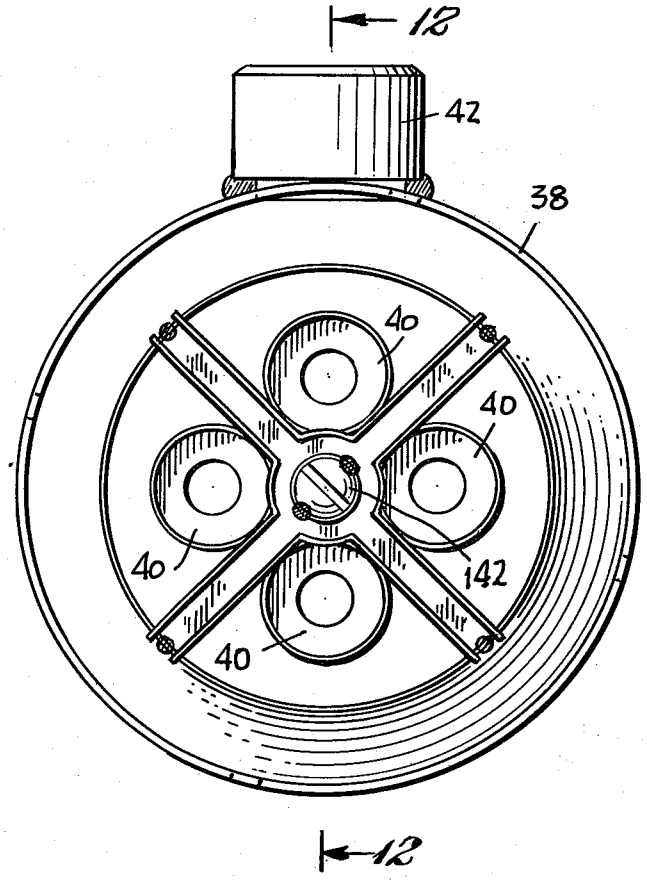
FIG. 11 is an end elevational view of the air inlet assembly of the gas burner.
Figure 12:
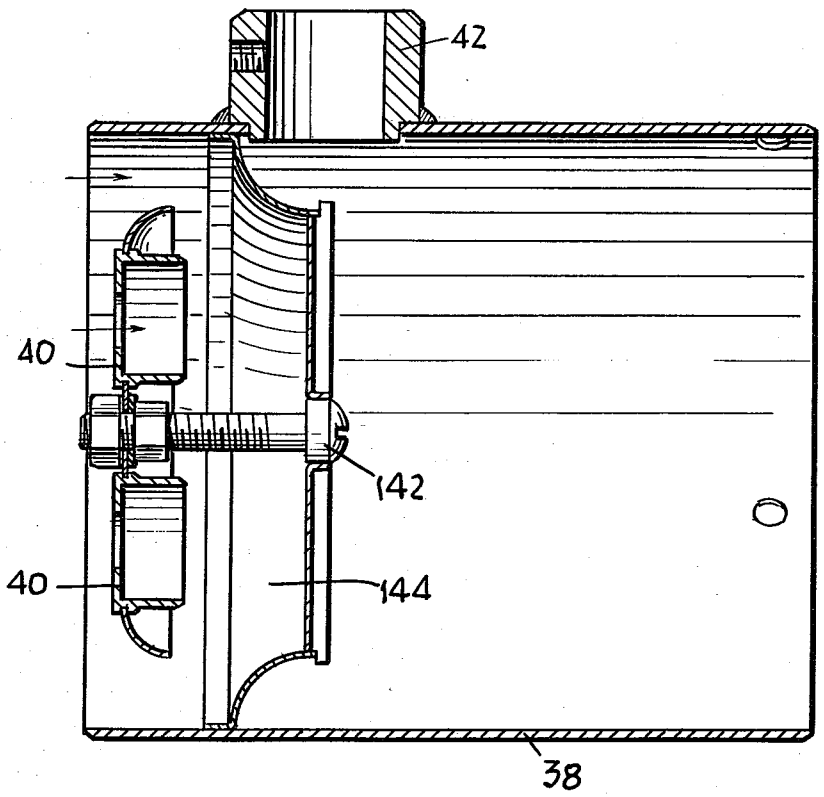
FIG. 12 is a view partly in axial section and partly in elevation, taken on the line 12—12 of FIG. 11.
Figure 13:
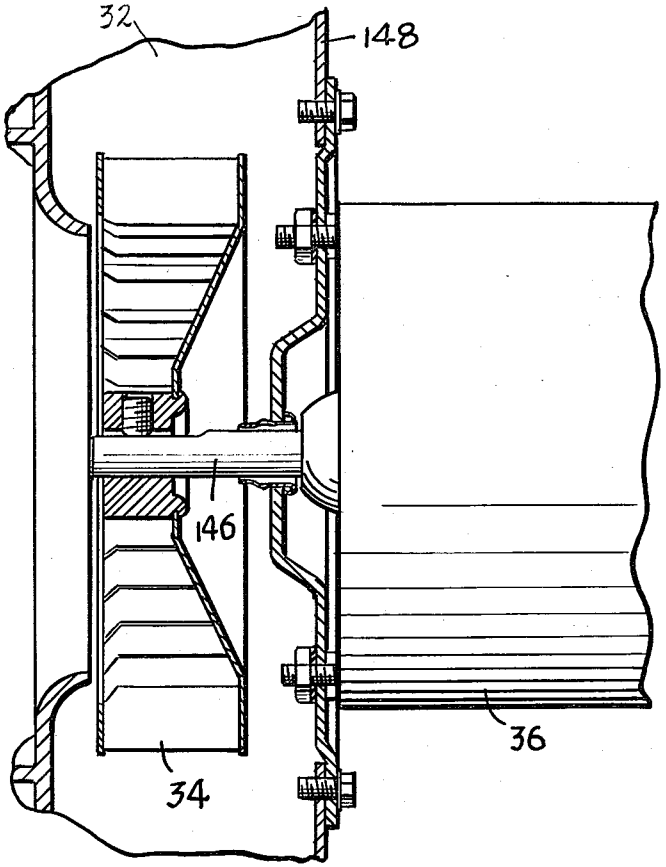
FIG. 13 is a fragmentary view of the blower and motor for the same, with the blower squirrel cage shown in section.

As seen in FIGS. 11 and 12, air is brought into the inlet tube 38 as indicated by the arrows, passing an air throttle member 40, and gas is brought in through a pipe nipple 42 disposed in a side wall. A suitable gas duct 44 connects the nipple 42 with a gas valve 46 by which metered amounts of gas are fed into the air inlet tube 38 to be premixed with the air coming in under the control of the throttle member 40.

Details of the gas valve per se are not given here since they form no part of the present invention.

Figure 3:
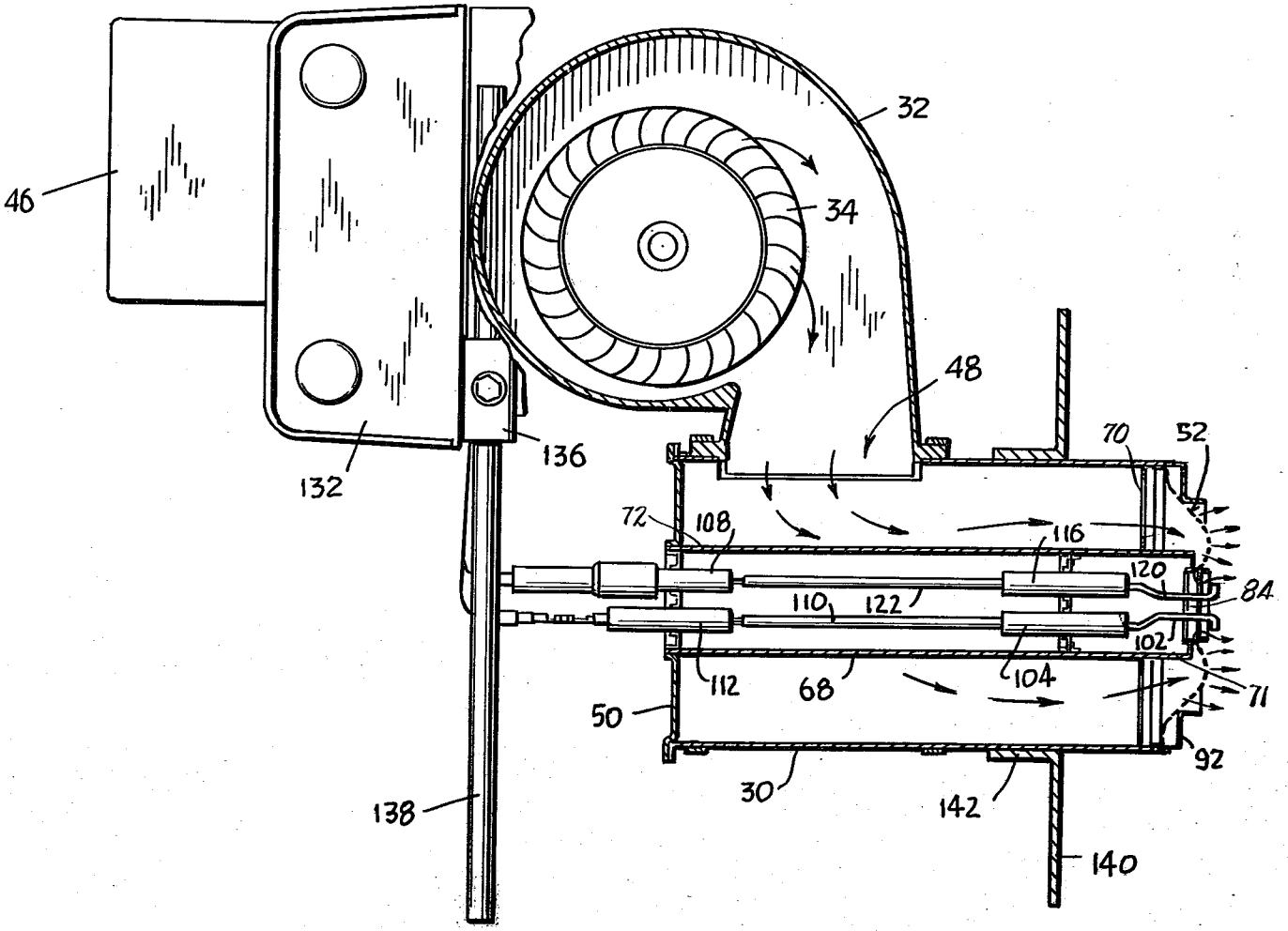
FIG. 3 is an axial sectional view of the gas burner, with portions shown in elevation.
Figure 4:
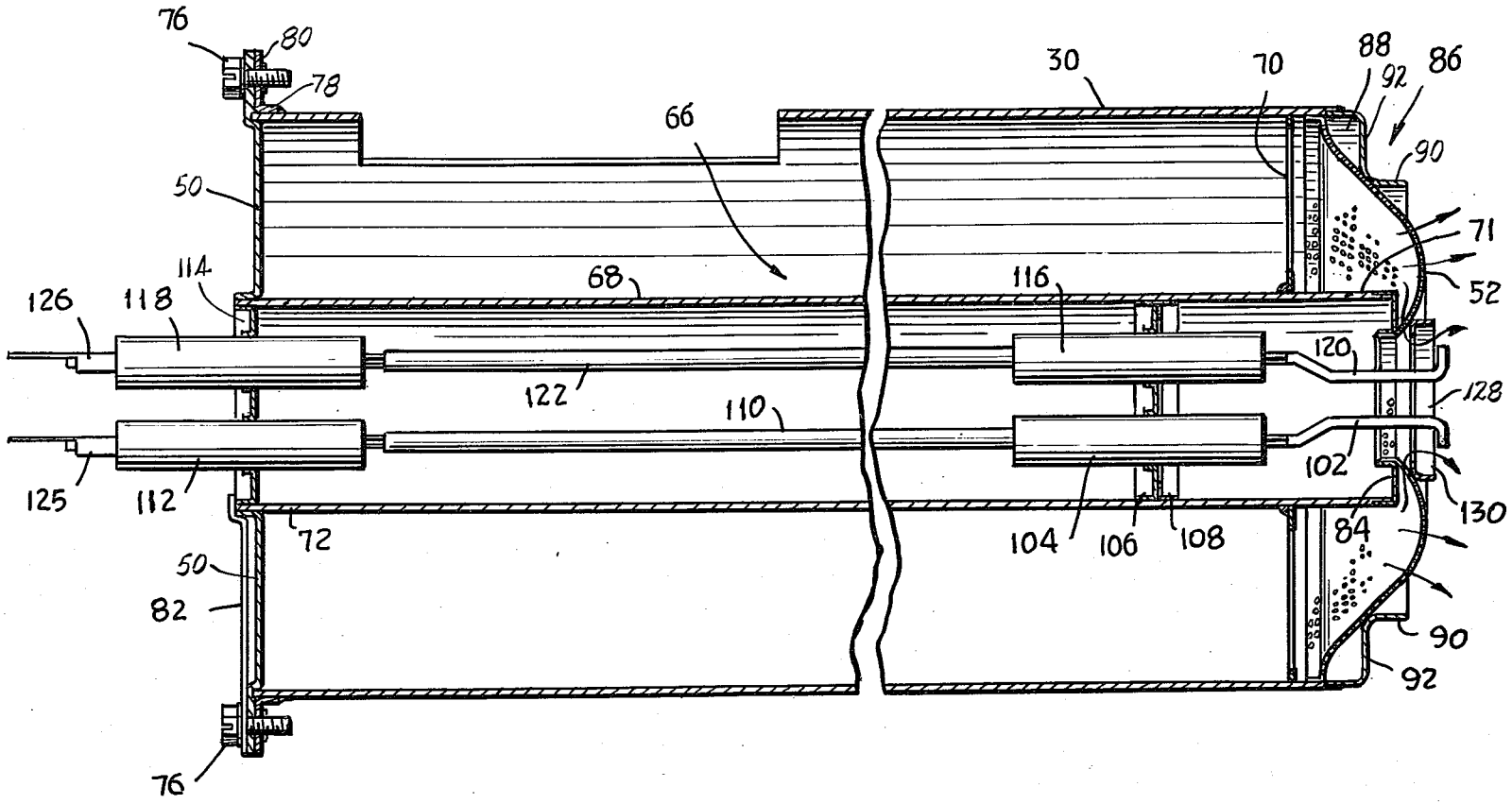
FIG. 4 is an axial sectional view of the air and ignition tube assemblies of the burner.

Considering again FIG. 3, the pre-mixed air and gas is discharged from the blower housing 32 through a discharge passage 48 into the upper portion of the air tube 30. The rear or outer end of the air tube 30 is closed off by a closure back plate 50 as seen in FIGS. 3 and 4, and the pre-mixed air and gas is forced forwardly through the air tube 30 to exit at the front or foremost end thereof.

In accordance with the present invention there is provided, at the foremost end of the air tube 30 a novel perforated burner plate 52 which is provided with a unique pattern of apertures that are advantageously arranged to minimize to the greatest possible extent the noise of combustion, eliminating screech, hoot and similarly high-pitched sounds and also minimizing the likelihood of flame blow-out. The perforated burner plate 52 also has a quenching action which prevents flash-back at low flow velocities of the air-gas mixture.

Further, in accordance with the present invention, the burner plate 52 is made with a bulbous configuration, having the form of an annulus of partial doughnut shape whereby it resists distortion such as may be caused by the stresses of repeated heating and cooling.

Figure 6:
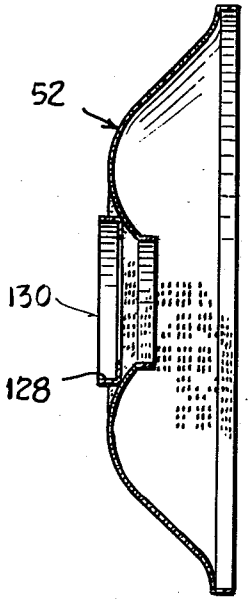
FIG. 6 is a diametric section of the burner plate, taken on the line 6—6 of FIG. 5.
Figure 5:
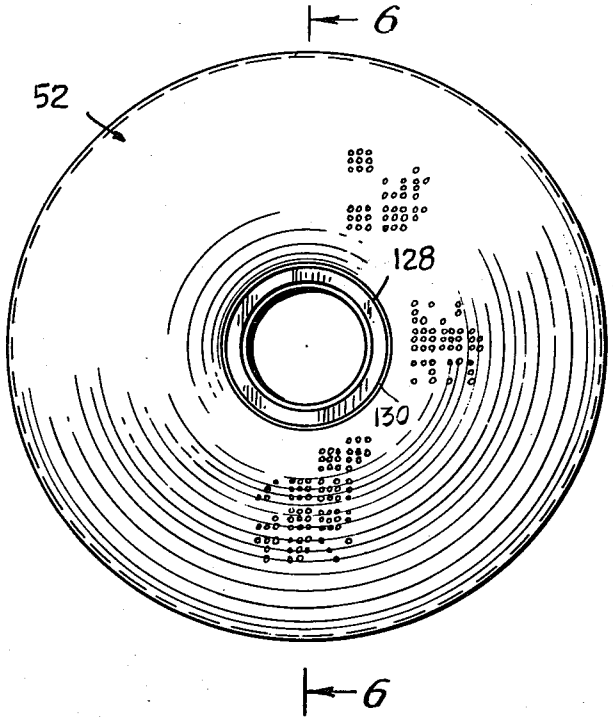
FIG. 5 is a face view of the burner plate of the gas burner.
Figure 9:
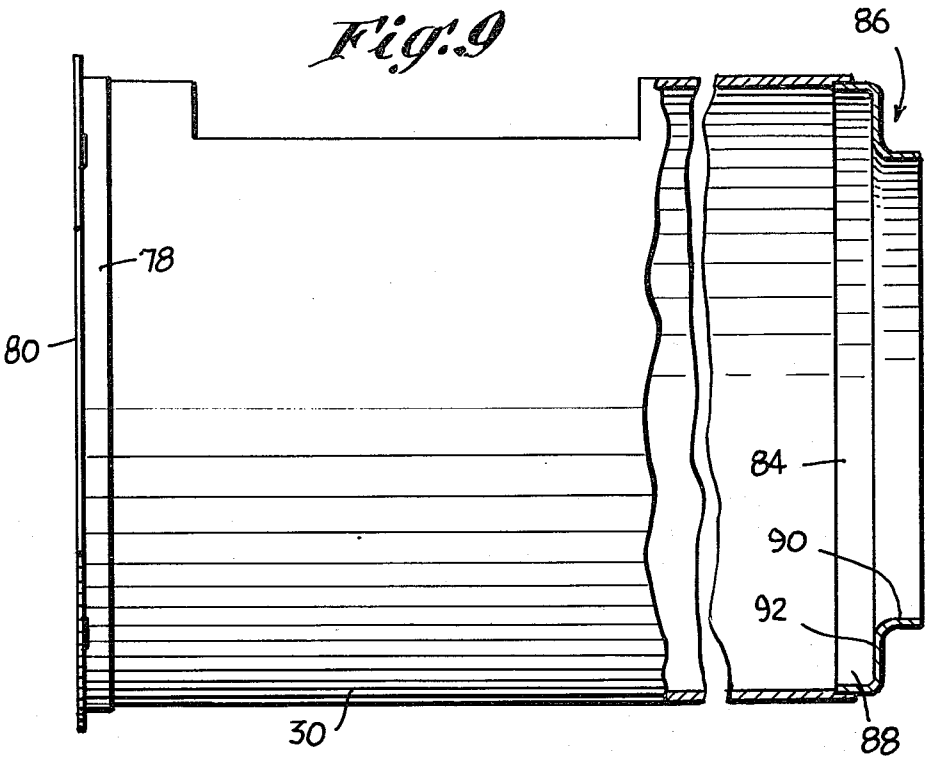
FIG. 9 is a view partly in side elevation and partly in axial section, of the air tube assembly of the burner.
Figure 7:
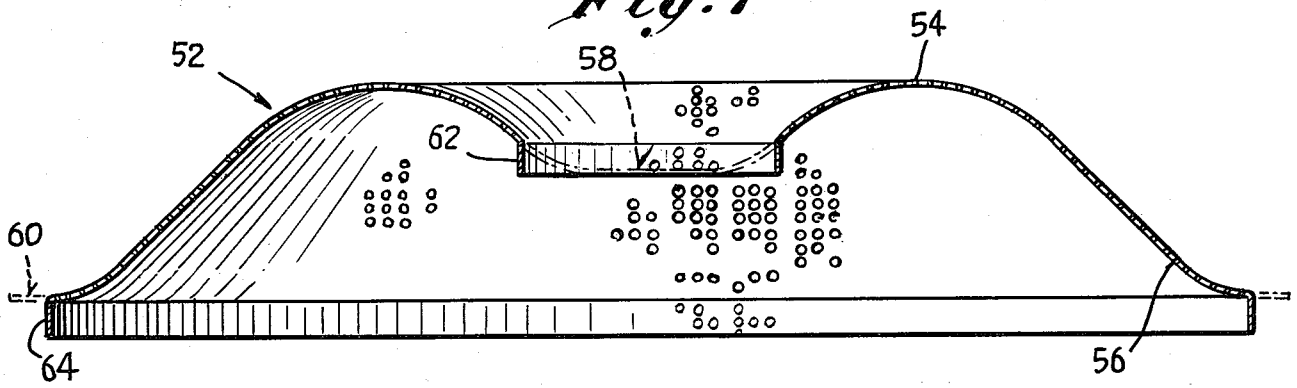
FIG. 7 is an enlarged sectional view of the burner plate of FIGS. 5 and 6, illustrating the configuration obtained by an initial stamping operation on a sheet metal blank.

Preferably, in accordance with the invention, the burner plate 52 is stamped out of sheet metal such as stainless steel, and is punched and further stamped to provide the final configuration as illustrated in FIGS. 5, 6 and 7.

Considering FIG. 7, the burner plate 52 is seen to have an inner peripheral or center annular portion 54 in cross section somewhat like a portion of a doughnut. Connected with the said center annular portion is an outer peripheral portion 56 which is of generally conical shape. As can be observed in FIG. 7, the burner plate 52 can be readily formed as a metal stamping, from stainless steel sheet, in which case the initial forming will provide a circular center portion 58 (shown dotted) and also a peripheral flange portion 60 shown dotted. The disk-shaped center portion 58 can be blanked and formed, and the outer peripheral portion 60 can be formed to provide short cylindrical sections 62, 64 respectively, by which the mounting of the burner plate 52 is facilitated.

Referring again to FIG. 4, the burner plate 52 is mounted on an ignition assembly designated generally by the numeral 66. This ignition assembly comprises an ignition tube 68 which is disposed concentrically within the air tube 30 and is supported therein by suitable spacer devices. One spacer device comprises a circular baffle plate 70 which is secured, preferably by welding, close to the innermost end 71 of the ignition tube 68.

At its outer end 72 the ignition tube 68 is supported in a central opening of the closure back plate 50 that is mounted by means of screws 76 to a plate mounting ring 78 that is welded to the air tube 30 at its outer end. The ring 78 has flanges 80 which are apertured and threaded to receive the screws 76. An ignition tube retainer member 82 is secured under one of the screws 76 to lock the ignition tube 68 in its operative position illustrated in FIG. 4.

At its innermost end 71 the ignition tube 68 has secured to it an ignition port ring 84, as by welding. The ring 84 has a central opening which closely slidably fits around the inner short cylindrical section 62 of the burner plate 52, thereby to mount the latter at the end of the ignition tube.

The baffle plate 70 and the burner plate 52 can be slidably received in the air tube 30, and constitute with the ignition tube 68 an assembly which can be readily removed from the air tube 30 when the retainer member 82 is taken off and the air tube closure back plate 50 is removed.

Positioning of the ignition tube assembly 68 is effected by a stop ring 86 which is welded to the innermost end of the air tube 30. The outer periphery of the burner plate 52 engages such stop ring as shown in FIG. 4, and this together with the abutting engagement of the retainer member 82 with the outer end of the ignition tube 68 precisely positions the latter within the air tube 30.

The stop ring 86 has a stepped configuration, with a large diameter portion 88 and a smaller diameter portion 90, joined by a flat ring-like portion 92. The stop ring 86 can be formed as a sheet metal stamping, and it will be seen that the flat ring-like portion 92 overlies an outer annular portion of the burner plate 52, thereby to limit the active area of the burner plate.

Figure 19:
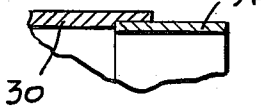
FIG. 19 is a fragmentary section through the inner edge of the air tube, showing an alternate form of stop ring for cooperation with the burner plate.

If a larger active area of the burner plate is required, the stop ring 86 can be replaced by a short cylindrical stop ring 94 as seen in FIG. 19. In such case the entire surface area of the burner plate 52 is available to constitute a base for the flame.

Figure 8:
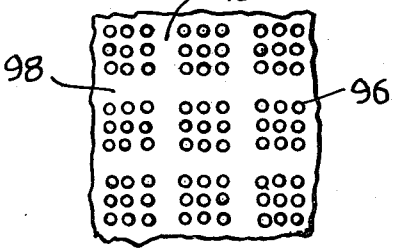
FIG. 8 is a fragmentary plan view of a portion of the surface of the burner plate of FIG. 7, illustrating the hole pattern.
Figure 10:
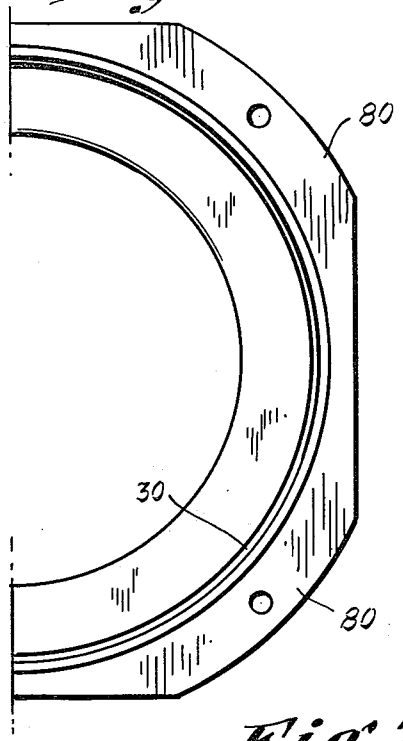
FIG. 10 is a partial end elevational view of the air tube assembly of FIG. 9.

The pattern of apertures with which the burner plate 52 is provided can be varied; it is essential, however, that groups of apertures are separated by solid avenue portions so as to form a predetermined pattern. In FIG. 8 such a pattern is illustrated, comprising a plurality of punched apertures 96 which are separated by solid horizontal and vertical avenues 98, 100. Each of the groups of apertures 96 comprises nine in number, arranged three across and three down.

I have found that an especially advantageous construction of the burner plate 56 is to utilize stainless steel having a thickness of about 0.018", with the punched holes 96 having a diameter of about 0.033". Also, the width of the solid avenues 98, 100 is advantageously made roughly triple the diameter of an aperture, or approximately 3/32".

Other patterns of holes and avenues are possible, as will be explained below in connection with FIGS. 14–18.

The entire effective surface of the burner plate 52 is provided with such punched apertures, which also appear on the cylindrical mounting portions 62 and 64. It will be seen in FIG. 4 that the stop ring 86 covers an annular outer peripheral portion of the burner plate 52 and closes off a certain percentage of the total number of apertures of the plate. This provides a smaller burner area for the flame, corresponding to a gas burner of smaller heat out-put. Where a large capacity gas burner is desired, the stop ring 86 is not used but instead the short cylindrical stop ring 94 is utilized, whereby the entire face area of the burner plate 52 is available to support the flame.

In accordance with the present invention a novel and improved ignition device is provided, by which there is had a reliable ignition of the air-fuel mixture at all times.

Referring again to FIG. 4, in the ignition tube 68 there is mounted an ignition electrode 102 which passes through an insulating bushing 104 carried in an apertured separator disk 106 that is slidable in the ignition tube 68 and sets against a stop ring 108 secured therein. The electrode 102 is attached to a lead 110 which passes through an outer insulating bushing 112 that is carried in an outer separator disk 114.

The separator disks 106 and 114 have additional apertures for insulating bushings 116 and 118 which carry respectively a sensing electrode 120 and a lead 122 to provide information for automatic control apparatus which forms no part of the present invention. The insulating bushings 104, 112, 116 and 118 are pressed in the separator disks 106 and 114.

The disks 106 and 114 are retained in place by the retainer member 82, which engages the outer separator disk 114.

The assembly of electrodes 102, 120 and associated bushings and separator disks can be removed as a unit from the ignition tube 68 without requiring removal of the latter from the burner, as can be understood. Suitable spade terminals 125 and 126 are provided on the leads 110, 122 as will be understood.

For cooperation with the ignition electrode 102 there is provided by the invention on the burner plate 52 a ground ring 128 which has a special configuration so arranged as to provide a stagnant area of fuel mixture at the sparking point of the electrode 102. The ground ring 128 is preferably welded to the burner plate 52, and has an "L" shaped cross-section by which a certain turbulence in the flow of fuel-gas mixture is established in the area at the inside of the ring. The electrode 102 is shaped to approach the outermost rim 130 of the ground ring 128, and thus arcing occurs in the area of turbulence and stagnant gas whereby a positive ignition is established at all times irrespective of the rate of flow.

FIG. 4 has arrows indicating the flow of the fuel mixture, and it will be seen that some of the mixture flows inside or through the ring 128, becoming stagnant whereby it is easily ignited.

In accordance with the invention, turbulence in the gas-air mixture is effected and utilized to good advantage, at the locations of each of the apertures in the burner plate 52. The punching of these apertures causes burrs to be formed at the under side of the plate. I have found that by positioning such underside to face the inside of the air tube 30 whereby the gas-air enters the apertures at the burrs, there is had more turbulence and a better combustion, with a shorter, more stable flame. This is illustrated diagrammatically in FIG. 26.

FIGS. 20–25 illustrate graphically the combustion conditions for various aperture sizes and arrangements. In FIG. 20 the condition of flash-back is shown, resulting from the use of large holes and a low flow rate. In FIG. 21 the hole size is smaller, and there is danger that the flame will extinguish. FIG. 22 shows small holes spaced apart too widely. The combustion is noisy and results in a high-pitched screech or hoot. Spacing the holes more closely as in FIG. 23 reduces the noise, but results in coalescing, lifting flames which are unstable and could extinguish. By utilizing the hole arrangement in FIG. 23 but with solid or imperforate separator areas which group the apertures, as provided by the invention, the flame is stabilized and noise eliminated.

If a thicker burner plate were to be used, requiring larger holes, there would be flashback and screech. The thicker plate is shown in FIG. 25, with the larger holes as done by punching.

Figure 27:
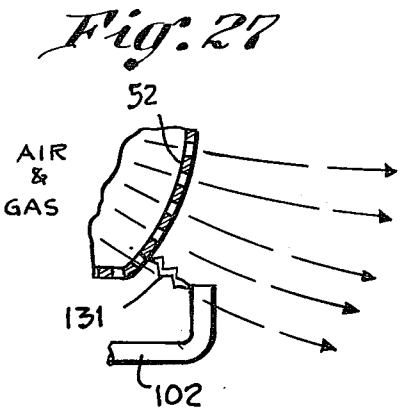
FIG. 27 is a diagrammatic showing of the ignition arcing parts when not utilizing the improved ignition device of the invention.
Figure 28:
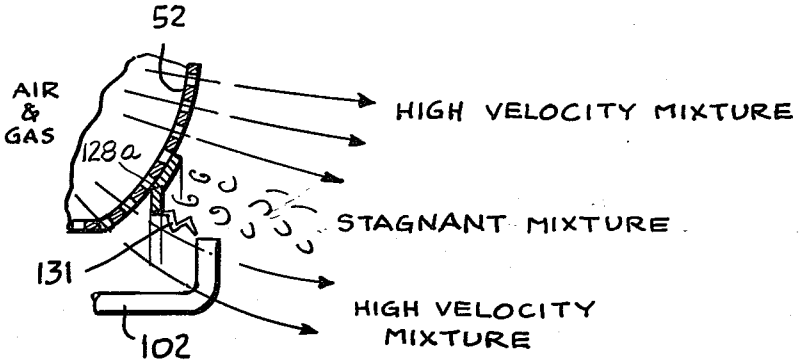
FIG. 28 is a view like that of FIG. 27 but showing a grounding ring used to improve the ignition.
Figure 29:
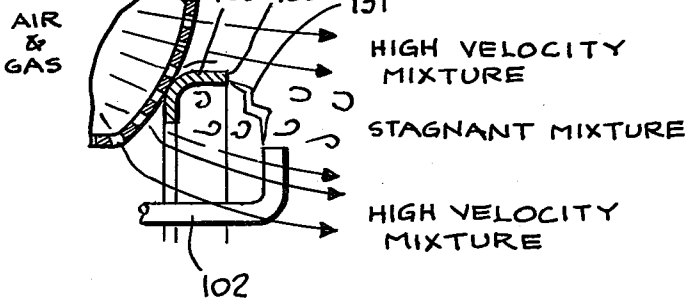
FIG. 29 is a view like those of FIGS. 27 and 28 but showing the improved grounding ring as provided by the invention.

The greatly improved ignition as provided by the invention is depicted in FIGS. 27–29. FIG. 27 shows a spark gap between the ignition electrode 102 and an adjoining area of the burner plate 52. The high velocity of the air-gas mixture at the spark 131 results in questionable ignition, since the sparking is often inadequate to properly heat the fuel. Placement of a ground ring electrode **128*a* on the burner plate 52 causes some stagnation of the fuel mixture and improves the ignition characteristic. By shaping the cross-section of the ground ring, as to the L-section configuration of the ground ring 128** provided by the invention, an improved stagnation area is had and the spark is disposed at the proper spot to give reliable ignition each time.

Referring to FIGS. 1 and 2, the gas burner includes an ignition transformer and sensing-control casing 132 which is secured to the blower housing 32 and also to the gas valve assembly 46. Leg brackets 136 carried by the casing 132 accommodate support legs 138 by which additional support is provided for the burner. A cover housing 139 is removable to reveal the above parts.

The air tube 30 is provided with a circular mounting plate 140 having a collar 142 which closely fits the air tube and is secured thereto. The mounting plate 140 is adapted for attachment to existing burner structures, at the front of the fire box, as will be understood.

Attached to the blower housing 32 is the air inlet tube 38 which has the throttle member 40 that is adjustable by means of a mounting screw 142. A cowling 144 is disposed within the air inlet tube 38, for cooperation with the throttle member 40, and gas is introduced into the air inlet tube 38 through the pipe nipple 42 that is connected to the gas valve 46.

The squirrel cage 34 of the blower is carried by a shaft 146 of the motor 36, which latter is mounted on a wall 148 of the blower housing 32.

Figure 14:
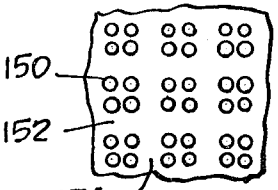
FIGS. 14, 15, 16, 17 and 18 are views like that of FIG. 8, showing various types of hole patterns with solid separating avenues, illustrating a number of different embodiments of the burner plate of the gas burner.
Figure 15:
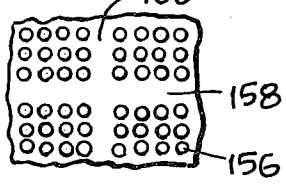
Figure 16:
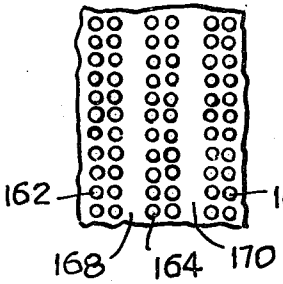

Referring to FIGS. 14–18, different patterns of apertures can be provided for the burner plate 52. In FIG. 14 the groups of apertures 150 each comprise four in number, separated by solid avenues 152, 154. In FIG. 15 the groups of apertures 156 comprise twelve in number, separated by solid avenues 158, 160. In FIG. 16 rows of apertures 162, 164 and 166 are separated by solid avenues 168, 170. Each row of apertures in FIG. 16 consists of two across.

Figure 17:
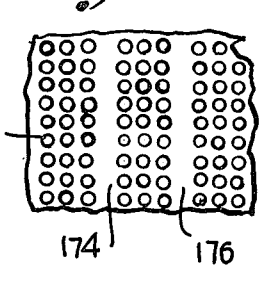
Figure 18:
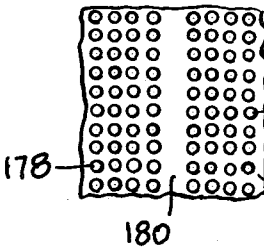

In FIG. 17 rows of apertures 172 which are three across are illustrated, separated by avenues 174, 176; and in FIG. 18 rows of apertures 178 which are four across, are separated by solid avenues 180, 182.

It will now be seen from the foregoing that I provided a novel and improved power gas burner wherein there is had a high degree of flame stability with a minimum of noise or screech. Moreover, an especially reliable ignition is obtained, and the construction details enable quick and easy assembly, and disassembly for purposes of servicing.

Variations and modifications are possible without departing from the spirit of the invention.

I claim:

1. A gas combustion burner, comprising in combination:

(a) a burner head for gaseous fuel, comprising an annular burner plate having inner and outer peripheries, and including a combustion face, said burner plate having and being covered over its entire effective surface with a multiplicity of groups of apertures to enable the gaseous fuel to pass therethrough for ignition at the combustion face thereof, and having a multiplicity of juxtaposed, solid avenue portions separating said groups of apertures, (b) said apertures and solid avenue portions forming a predetermined pattern on said combustion face characterized by the apertures of the groups being closely spaced with respect to each other so as to permit the flow of gaseous fuel through the plate at designated areas and the avenue portions preventing the flow at adjoining areas thereby to prevent flame blow-out while at the same time minimizing combustion noise, (c) said burner plate comprising sheet metal and having a circular ignition ring secured to it at a location juxtaposed to and spaced outward from the inner periphery, said ring surrounding an apertured circular area of the plate, (d) one side of the annular area of said burner plate having burrs surrounding the apertures thereof and forming a rough side on said plate, (e) an air tube carrying said burner plate adjacent one of its ends, said plate spanning the end area of the tube, (f) that side of the annular area of the burner plate which has said burrs and rough side facing inwardly of said air tube, and (g) an ignition electrode passing through the inner periphery of the burner plate and through said ignition ring, for cooperation with the latter to ignite gas passing through said annular area of the plate.

2. A gas combustion burner, comprising in combination:

(a) a burner head for gaseous fuel, comprising a burner plate including a combustion face, said burner plate having and being covered over its entire effective surface with a multiplicity of groups of apertures to enable the gaseous fuel to pass therethrough for ignition at the combustion face thereof, and having a multiplicity of juxtaposed, solid avenue portions separating said groups of apertures, (b) said apertures and solid avenue portions forming a predetermined pattern on said combustion face characterized by the apertures of the groups being closely spaced with respect to each other so as to permit the flow of gaseous fuel through the plate at designated areas and the avenue portions preventing the flow at adjoining areas thereby to prevent flame blow-out while at the same time minimizing combustion noise, (c) said burner plate being annular with a major central apertured portion thereof shaped like one side of a doughnut, (d) an ignition tube attached to the inner periphery of said major central portion, (e) electrical conductor means in said ignition tube, including an electrode carried by said tube and disposed at said inner periphery of the burner plate to ignite said gaseous fuel, (f) an igniting ring secured to said major central apertured portion adjacent to and spaced outward from the inner periphery of the burner plate, said ring surrounding the apertured circular area of the plate and being adapted to coact with said ignition electrode for producing a spark at said inner periphery for the purpose of igniting gas passing through said annular area of the plate, said ring surrounding said electrode.

3. The invention as defined in claim 2, wherein:

(a) a major outer peripheral portion of the plate is generally conical.

4. The invention as defined in claim 3, wherein:

(a) the inner and outer peripheries of the burner plate have short cylindrical sections to facilitate the mounting thereof.

5. The invention as defined in claim 4, and further including:

(a) an air tube surrounding said ignition tube and having an internal stop shoulder at its inner end, (b) the cylindrical section of the outer periphery of the burner plate snugly fitting the inside of the air tube and engaging said stop shoulder to position the plate.

6. The invention as defined in claim 2, wherein:

(a) the burner plate has some of its apertures disposed in said circular area at said inner periphery, (b) said ignition ground ring being carried by the burner plate at a location surrounding said circular area, (c) said ignition electrode extending through the inner periphery of the burner plate and through said ground ring in spaced relation to the ground ring and being cooperable therewith to produce an ignition spark for igniting gas passing through said annular area.

7. The invention as defined in claim 6, wherein:

(a) the ignition ground ring is of cupped configuration to produce a stagnant zone of the fuel mixture at the place where the arc occurs between the ignition electrode and the ground ring.

8. The invention as defined in claim 7, wherein:

(a) the ignition ground ring has an angular cross section.

9. A burner head for gaseous fuel, comprising a burner plate including a combustion face, said burner plate having a multiplicity of groups of apertures to enable the gaseous fuel to pass therethrough for ignition at the combustion face thereof, and having a multiplicity of juxtaposed, solid avenue portions separating said groups of apertures, said apertures and solid avenue portions forming a predetermined pattern, on said combustion face, which permits the flow of gaseous fuel through the plate at designated areas and prevents the flow at adjoining areas so as to prevent flame blow-out while at the same time minimizing combustion noise, (a) said burner plate being annular with a major central portion thereof shaped like one side of a doughnut, (b) a major peripheral portion of the plate being generally conical, (c) the inner and outer peripheries of the burner plate having short cylindrical sections to facilitate the mounting thereof, (d) an air tube having an internal stop shoulder at its inner end, (e) the cylindrical section of the outer periphery of the burner plate snugly fitting the inside of the air tube and engaging said stop shoulder to position the plate, (f) an ignition tube disposed within the air tube, (g) said ignition tube having a baffle engaging the inside of the air tube, and having within its inner end a fixed ring providing a port for electrodes, (h) the inner periphery of the burner plate being engaged with said fixed ring.

* * * * *